US005564336A

United States Patent [19]

Straubinger et al.

[11] Patent Number: 5,564,336

[45] Date of Patent: Oct. 15, 1996

[54] ROTARY INTAGLIO PRINTING MACHINE

[75] Inventors: Werner Straubinger, Nürnberg; Günter Pecher, Sugenheim; Richard Kohlmann, Burgtann, all of Germany

[73] Assignee: U.E. Sebald Druck Und Verlag GmbH, Nurnberg, Germany

[21] Appl. No.: 339,158

[22] Filed: Nov. 9, 1994

Related U.S. Application Data

[63] Continuation-in-part of Ser. No. 141,910, Oct. 27, 1993, abandoned.

[30] Foreign Application Priority Data

Oct. 28, 1992 [DE] Germany ..... 42 36 457.4
Dec. 16, 1993 [DE] Germany ..... 43 43 085.6

[51] Int. Cl.[6] ..... B41F 9/02; B41F 23/04

[52] U.S. Cl. ..... 101/152; 101/424.1

[58] Field of Search ..... 101/181, 228, 101/136, 138, 139, 143, 178, 182, 424.1, 152, 153, 180; 34/444, 448, 459, 460, 461

[56] References Cited

U.S. PATENT DOCUMENTS

| | | | |
|---|---|---|---|
| 1,640,977 | 8/1927 | Brueshaber | 101/180 X |
| 1,796,643 | 3/1931 | Ball | 101/180 X |
| 1,834,147 | 12/1931 | Dausmann | 101/424.1 |
| 2,036,158 | 3/1936 | McGiehan | 101/152 |
| 2,306,607 | 12/1942 | Horton | 101/424.1 X |
| 2,333,220 | 11/1943 | Weiss | 101/152 |
| 3,280,737 | 10/1966 | Huck | 101/181 |
| 3,851,582 | 12/1974 | Saueressig et al. | 101/181 |
| 4,586,434 | 5/1986 | Tokuno et al. | 101/178 |
| 5,060,572 | 10/1991 | Waizmann | 101/424.1 |

*Primary Examiner*—J. Reed Fisher

*Attorney, Agent, or Firm*—Sughrue, Mion, Zinn, Macpeak & Seas

[57] ABSTRACT

A rotary intaglio printing machine has at least two printing mechanisms and a drying device arranged between the printing mechanisms, through which a web of paper to be printed upon successively passes. The printing mechanisms are so arranged that the web of paper is guided only by the plate cylinders and the impression cylinders of the printing mechanisms in a straight line from the preceding printing mechanism through the drying device in a contact-free mode to the following printing mechanism. The drying apparatus includes a housing through which the web of paper passes, as well as a fan arrangement and nozzle pipes which extend transversely to the direction of movement of the web of paper substantially over the entire width thereof and by which air, that is sucked out of the housing by the fan arrangement, is blown onto the web of paper. In order considerably to reduce the energy expenditure required for operation of such a drying apparatus, relative to the drying effect achieved, the nozzle pipes are arranged only on the freshly printed side of the web of paper and disposed on the side of the web of paper, that is opposite to the nozzle pipes, is a guide surface at which the web of paper is supported in a contact-free manner by way of an air cushion which is built up in an air gap formed between the web of paper and the guide surfaces.

17 Claims, 3 Drawing Sheets

ROTARY INTAGLIO PRINTING MACHINE

This is a Continuation-in-Part of application Ser. No. 08/141,910 filed Oct. 27, 1993 now abandoned.

BACKGROUND OF THE INVENTION

The invention concerns a rotary intaglio printing machine and a rotary intaglio printing process.

A rotary intaglio printing machine, and a process for rotary intaglio printing, as described for example in German Patent 35 30 561, involve passing a web of paper to be printed upon through at least two press units, each of which comprises a printing mechanism, with a drying device arranged between the printing mechanisms, for successively applying at least two inks to one and the same side of the web of paper as it passes through the machine. In order to provide for multi-ink or multi-color printing on the web of paper, each printing ink has its own printing mechanism. The main components of each such printing mechanism are a rotary form or plate cylinder which dips into an ink trough or fountain and against which the web of paper, as it passes through the printing mechanism, is pressed by means of a rotating impression cylinder. The plate cylinder and the co-operating impression cylinder form therebetween a gap or nip which is referred to herein as the printing nip. The web of paper is fed to the printing nip of the printing mechanism from above. The web of paper is guided and changed in its direction of run, by means of guide spindles. Downstream of each printing nip, the web of paper must pass through drying devices as, unlike the situation in offset printing, the rotary intaglio printing process provides that the freshly applied ink is very substantially dried before the next ink is applied to the web of paper.

The drying devices may be formed by drying cylinders, as in German Patent 35 30 561, or by downwardly open, box-like dryer housings which are disposed above each printing mechanism and into which the web of paper issuing from the printing mechanism passes. In the dryer housing the web of paper is guided over a distance which is as long as possible, by means of guide and direction-changing rollers, which are referred to as guide spindles, before the web of paper passes from above to the next printing mechanism in order to be printed upon therein with a further ink.

In order to carry out the drying operation, provided in each of the dryer housings are so-called impingement jet nozzle arrangements which are disposed in respective pairs on mutually opposite sides of the web of paper. Each of those impingement jet nozzle arrangements includes a plurality of nozzle pipes which are parallel to each other and which are arranged in succession in the direction of movement of the web of paper, in such a way that they extend transversely to the direction of movement, substantially over the entire width of the web of paper. Each of the nozzle pipes has a plurality of air discharge nozzles with which the nozzle pipe faces the respective side of the web of paper at a small spacing therefrom. A specific fan is provided for each impingement jet nozzle arrangement, the fan sucking air out of the interior of the dryer housing and feeding it to the nozzle pipes, the air issuing in a jet through the nozzle openings of the nozzle pipes and impinging on the respective side of the web of paper. As that air is heated, in results in drying of the ink applied in the preceding printing mechanism, that is to say the solvent in the ink, for example toluene, is caused to diffuse extensively out of the application of ink and the paper. As a result the air which is circulated in the dryer housing by the fan has an increased content of solvent vapours. In order to prevent the concentration of solvent vapours from rising above an admissible value (generally 50% of the lower explosion limit), air must be continuously sucked away out of the dryer housing and fed to a solvent separation installation.

The solvent separation installation operates all the better, the greater the degree to which the air supplied thereto is charged with solvent vapours. The optimum procedure therefore would involve going as closely as possible to the above-mentioned admissible limit value. That is not possible in practice however because another purpose of sucking air out of the dryer housing is to generate a reduced pressure which is intended as far as possible to prevent solvent vapours from being blown out of the dryer housing into the area immediately surrounding it. Because of the great width of the openings which the dryer housing has, in particular towards the printing mechanism which is disposed therebeneath, for the last-mentioned purpose air must be sucked out of the dryer housing to such a great degree that the optimum level of solvent concentration is far from being attained. Nonetheless, it is not possible totally to prevent solvent vapours from issuing into the area surrounding the dryer housings and printing mechanisms, so that the entire printing machine must be covered over with a downwardly open hood from which air is further sucked so that the solvent vapours which accumulate in the hood are also fed to the separation installation. The level of solvent concentration in the air which is sucked out of the machine hood is even lower and thus more disadvantageous, than in the air which is taken from the dryer housings.

Disadvantages arise not only from the high level of energy expenditure which is required for operation of the known dryer apparatuses but also from the large number of the above mentioned guide spindles.

As for example eight printing units are required for printing in four colors on both sides of a web of material, and each of the printing units includes typically between about seven and ten guide spindles, the previous rotary printing machines suffer from a series of difficulties:

Thus for example a major problem is that none of the many guide spindles has its own drive means, but each is driven in rotation by the web of paper to be printed upon. The result of that arrangement is that a large amount of wastage is produced at each change in speed of the machine, in particular when the machine starts up and stops. More specifically, when for example the web of paper is accelerated, the guide spindles exert a retardation effect while when the web of paper slows down, the guide spindles have a tendency to continue to rotate at their previous high speed so that they first have to be retarded by the web of paper. Accordingly, when there is a change in the speed of movement of the web of paper through the machine, a period of time elapses before the newly intended stable condition is reached, in which the register condition of the web of paper can be regulated with the required degree of accuracy. All of the paper which is in the machine and which passes into the machine in such a transitional period is printed upon with an inadequate degree of register accuracy, and is therefore not suitable for use.

Particular problems arise if the machine has to be stopped very quickly for example because of a fire or because the web of paper tears. Not least because of the enormous size of the conventional rotary intaglio printing machines which are more particularly suitable for printing in four colors on both sides of a web of paper however malfunction situations of that kind are not infrequent and, depending on the printed item being produced, an amount of wastage of between 6% and 10% generally has to be tolerated.

SUMMARY OF THE INVENTION

An object of the present invention is to provide a rotary intaglio printing machine which affords a substantially higher degree of operational reliability and which is more responsive to changes in the operating mode thereof.

Another object of the present invention is to provide an improved rotary intaglio printing machine capable of at least substantially reducing the amount of wastage of paper printed therein.

Yet another object of the present invention is to provide a rotary intaglio printing machine which is less labor-intensive in terms of machine operation.

A further object of the present invention is to provide a rotary intaglio printing process which affords improved printing results with enhanced reliability and simplicity of operation.

A still further object of the present invention is to reduce the energy expenditure required for operation of the dryers without adversely affecting the dryer efficiency.

In accordance with the principles of the present invention in a first aspect the foregoing and other objects are achieved by a rotary intaglio printing machine in which a web of paper to be printed upon passes through at least two printing mechanisms, and a drying device arranged between the printing mechanisms, for successively printing with at least two inks on one and the same side of the web of paper. The at least two printing mechanisms are so arranged that the web of paper is guided by the plate cylinders and impression cylinders of the printing mechanisms in a straight line from the preceding or upstream printing mechanism through the interposed drying device to the following or downstream printing mechanism, with the printed side of the web of paper coming into contact only with the plate cylinders of the printing mechanisms.

Furtheron in the dryer the nozzle pipes are arranged only on the freshly printed side of the web of paper and on the side of the web of paper, that is opposite to the nozzle pipes, there is arranged a guide surface at which the web of paper is supported in a contact-free manner by way of an air cushion.

In a second aspect of the invention the foregoing and other objects are achieved in a rotary intaglio printing process which provides that a web of paper to be printed upon is passed through at least two printing mechanisms, by means of which respective inks are successively applied to one and the same side of the web of paper, with a drying operation being effected between the two printing mechanisms. The ink which is applied to the web in the preceding or upstream printing mechanism is dried only to such an extent that satisfactory wiping-resistant printing is possible in the following or downstream printing mechanism, while the web of paper is guided from the printing nip of the upstream printing mechanism to that of the downstream printing mechanism in such a way that at least the side of the web of paper, which is printed upon by the printing mechanisms, remains contact-free.

In accordance with the invention it has been found that, with the intaglio printing inks available nowadays, it is generally entirely sufficient if the uppermost or outermost layer of the ink applied to the web of paper in the respective preceding or upstream printing mechanism is dried to such an extent as to be wiping-resistant, that is to say, it cannot be smudged, so that the next ink can then be applied to the web of paper in the downstream printing mechanism, without problems arising. There is therefore no longer any need for the ink applied in the upstream printing mechanism to be completely and entirely dried before the next following ink is applied to the web of paper. Therefore, the drying devices disposed between the successive printing mechanisms can be of a straight-line configuration and so short that the guidance effect imparted to the web of paper by the plate cylinders and the impression cylinders of the upstream and downstream printing mechanisms is fully sufficient to ensure that the web of paper moves in the required direction. There is no need for the web of paper to be additionally guided between the printing mechanisms which successively apply printing to the same side of the web of paper, and in particular there is no need for the web of paper to be additionally guided in the drying devices between the printing mechanisms, so that the major part of the above-mentioned guide spindles which were used hitherto can be omitted. It is in fact possible for a rotary intaglio printing machine according to the invention, which includes eight printing mechanisms, for four-color printing on both sides of a web of paper, to be equipped overall with no more guide spindles than are employed in a conventional machine for a single printing mechanism.

That configuration gives rise to a number of advantages as follows:

The distance covered by the web of paper within the machine is considerably reduced in length. As a result, the reliability of the machine is substantially enhanced, in regard to ensuring that the web of paper moves in the correct direction as it passes through the printing machine. The risk of the web of paper tearing is greatly reduced. If nonetheless such a malfunction situation occurs, the machine can be stopped much more quickly because the greatly reduced number of guide spindles store considerably less rotational energy which has to be converted into heat when the machine is brought to a halt. In the event of an operational change in the speed of movement of the web of paper through the machine, the above-mentioned deceleration effects produced by the guide spindles are also greatly reduced so that the new set printing speed can be achieved considerably more quickly. As the length of the web of paper in the machine at any time is substantially shorter than in the case of a conventional machine, the amount of paper wastage is greatly reduced as a result.

The web of paper is subjected to substantially less resistance and as a result is subjected to less stretching. The degree of register accuracy is considerably increased in that way.

The energy requirement is greatly reduced because of the lower levels of frictional losses and the reduced 'stored' rotational energy of the guide spindles, which would have to be converted into waste heat when the machine is brought to a halt.

Another major advantage of the fact that the web of paper is guided in a straight line in a contact-free manner from one printing nip of a printing mechanism to the next is that in particular the machine according to the invention does not require the guide spindles which, in prior machines, are arranged parallel to the plate cylinder of a printing mechanism, immediately upstream and downstream of the printing nip thereof. In such a machine, such guide spindles guide the web of paper which arrives at the printing mechanism from above, for it to pass through the printing nip, and to deflect it from a substantially vertical path of movement into a horizontal path of movement and thereafter back upwardly again. It will be seen therefore that, in operation, at least one of those guide spindles is necessarily disposed in the region of the path of movement along which the plate cylinders must move when for example the plate cylinder of a printing mechanism has to be exchanged for another plate cylinder, for example when converting the machine to print a different printed product. Such a cylinder exchange operation is complicated by virtue of the fact that each of the two shaft journals which project beyond the ends of the plate cylinder for rotatably supporting same are mounted in a ring bearing arrangement which in turn is carried on the frame structure of the machine. When replacing a plate cylinder, the plate cylinder is lifted by means of a special lifting device together with the two ring bearings upwardly off the machine frame structure and then displaced parallel to itself and transversely to its longitudinal axis, into the free space between the printing mechanism of which it is a part, and the adjacent printing mechanism. The ring bearings are then removed in an axial direction and the plate cylinder is moved out of the space between the printing mechanisms, by displacement in its lengthwise direction.

Conversely, the fresh plate cylinder to be installed is moved into the space between the printing mechanisms, in the lengthwise direction of the cylinder, and, after the ring bearings have been fitted on to its shaft journals, the new plate cylinder is moved transversely relative to its longitudinal direction into a position above its actual working location into which it can then be finally lowered.

It will be seen therefore that, in order to produce those movements of the plate cylinders, in the prior machine, not only was it necessary for the respective impression cylinder to be lifted by a considerable distance to allow the plate cylinder to be removed, but in addition it was also necessary to move away the guide spindle disposed at the side of the printing mechanism, towards which the plate cylinder is removed. That operation requires an expensive mechanism which can be eliminated together with the above-mentioned guide spindles in a rotary intaglio printing machine in accordance with the principles of the present invention. That means that the structure of the invention also considerably simplifies installation and removal of the plate cylinders, and makes automation of that operation more readily available.

In accordance with a preferred feature of the invention, the printing mechanisms for printing on one side of a web of paper are positioned in vertically superposed relationship in a tower-like arrangement so that the web of paper can pass perpendicularly therethrough. That configuration results in the amount of floor space taken up by such a machine being greatly reduced.

A further advantage of the tower arrangement is that each of the impression cylinders, in operation, is no longer disposed exactly above the associated plate cylinder and presses on to same from above. On the contrary, it is possible for the impression cylinder to be positioned substantially laterally of the plate cylinder and with its axis only slightly above the axis of rotation of the co-operating plate cylinder. As a result, for exchanging the plate cylinder, there is no need for the impression cylinder to be raised considerably out of its operating position; instead, it is sufficient for it to be pivoted slightly away from the plate cylinder, and a substantially simpler form of mechanism can be used for that purpose. Accordingly, the tower-like arrangement of the printing mechanisms also contributes to greater ease and simplicity in removing and installing the plate cylinders.

In accordance with a preferred feature of the invention, in order to particularly minimise the height by which the plate cylinder has to be raised for removal thereof and lowered for installation thereof, the plate cylinder, instead of being supported by the hitherto conventional ring bearings for each shaft journal of the plate cylinder, is supported by a backrest-like or cradle-type bearing means which thus comprises for example one, two or three support rollers and which is open upwardly in such a way that the plate cylinder with its journals can be easily lifted upwardly and forwardly therefrom to remove the plate cylinder and can be inserted from the front and from above of the bearing means, for fitting the plate cylinder. Such bearing means can be fixedly connected to the machine frame structure in such a way that they can be displaced to adapt same to different plate cylinder diameters. The cradle-type configuration of the support bearing means provides that this eliminates the operation of withdrawing ring-type bearings from a plate cylinder which is to be removed and subsequently re-fitting same on to the shaft journals of a fresh plate cylinder to be installed.

In practice, the operations of removing and refitting support bearing means for the plate cylinder may be effected quite frequently for the reason that the plate cylinder journals must very accurately fit into the inner track race rings of the support bearings so that they cannot tilt or tip. If the plate cylinder to be installed is only a few degrees C. too hot, which is easily possible by virtue of a preceding galvanic treatment, the bearing means, because of the radial expansion of the shaft journals due to the increased temperature obtaining, can frequently not be fitted on to the shaft journals until the shaft journals have suitably cooled down. All such difficulties are eliminated when using cradle-type bearings in accordance with the invention. As cradle-type bearings provide that the bearing forces must be carried by a small number of bearing elements for longer periods of time than in the case of ring-type bearings which are conventionally used, it was hitherto assumed that cradle-type bearings would heat up excessively, particularly at high speeds of rotation as are used nowadays in rotary intaglio printing machines, and would not be capable of supporting a plate cylinder with the required degree of stability. It has surprisingly been found in practice however that such fears are unfounded, and it is entirely possible to provide for adequate cooling for the bearing means and the weight of the plate cylinder and the pressing force of the impression cylinder are entirely sufficient to ensure a stable mounting configuration.

A further impediment in the above-mentioned operation of removing and installing a plate cylinder, by movement thereof transversely to its longitudinal direction, was hitherto the doctor arrangement which, in the prior machines, is so positioned that the generatrix along which the doctor member is in contact with the plate cylinder is disposed as closely as possible to the printing nip, that is to say above the axis of rotation of the plate cylinder. That was deemed necessary in order to ensure that the printing ink in the depressions or recesses in the plate cylinder did not dry as it moved between the doctor member and the surface of the paper to which the ink was to be applied. However, that risk no longer applies, not least because of the high printing speeds of modern rotary intaglio printing machines.

In accordance with a preferred feature of the machine of the invention therefore the doctor arrangement is so positioned that the generatrix along which the doctor blade is in contact with the plate cylinder is no higher than, and preferably lower than, the axis of rotation of the plate cylinder when in its operative position. In that way the doctor arrangement is disposed outside the region through which the plate cylinder is moved when being removed or installed. The hitherto complex mechanism required for lowering the doctor arrangement and pivoting it out of the way can thus be eliminated and it is now only necessary to provide means for adapting the position of the doctor arrangement to different plate cylinder diameters. That design configuration therefore also contributes to greater simplicity in the operation of removing and installing the plate cylinder, so that it can be more easily automated.

A particular advantage of the above-mentioned tower arrangement of the printing mechanisms is that the building in which the machine is disposed can be in the form of a capsule into which the web of paper passes through a narrow slot which can be closed and leaves it again, after the printing and drying operations, through a preferably oppositely disposed, also narrow slot which can also be closed.

Encapsulation of the machine in that way permits extremely effective sound-proofing relative to the exterior and permits the solvent which is given off when the ink or inks dry to be practically completely recovered. As no one has to stay within the encapsulating enclosure while the machine is operating, the values of maximum solvent concentration at the working station can be reduced to a minimum, so that they can be considerably below the permitted levels.

In the event for example of a fire within the encapsulating enclosure, which can be very easily detected by virtue of the compact, self-contained arrangement, it is possible for the web of paper passing through the arrangement to be automatically capped at the entry and exit slots, in order to close off those slots within a very short period of time, whereupon the entire encapsulating enclosure can be flooded with $CO_2$ within a few seconds. That can substantially enhance the safety and environmental compatibility of such machines.

In accordance with another preferred feature of the invention, beside the printing mechanism tower arrangement or arrangements, the machine may have a respective elevator means, within or outside the encapsulating enclosure, which permits a plate cylinder which is no longer required to be removed from the printing mechanisms of a tower, so that fresh plate cylinders can then be installed in the next working operation.

Furtheron, it also has been found that the drying effect which is produced by the impingement jets decrease greatly with an increasing degree of drying, as a gel layer is formed on the surface of the ink, and that gel layer permits scarcely any solvent to come out of deeper layers of the ink, to the surface thereof, even when each portion of the web of paper has a prolonged residence time in the dryer and even when a higher approach flow speed is employed. The attempts made hitherto to achieve an improved thorough drying effect by higher and higher fan outputs and longer and longer distances over which the web of paper moves in the dryer housing, have therefore resulted in an increase in expenditure, which is greatly over-proportional in comparison with the effect achieved.

In particular it follows from the foregoing realisation, that the air jets which are blown from one of the two impingement jet nozzle arrangements against the side of the paper web which is "dry", that is to say not freshly printed upon, make virtually no contribution to the drying effect. Accordingly, they essentially only serve to support the paper web against the pressure of the air jets which are blown against the "wet" side of the web of paper.

As tests carried out in a practical context have shown, a support action of that kind, which is afforded by means of the guide surface provided in accordance with the invention, is possible in a completely satisfactory manner, in particular when very high speeds of movement of the paper web are involved. That is surprising insofar as it could initially be assumed that the high speed at which the web of paper moves would cause a venturi effect between the flat surface of the web of paper and the flat surface region of the guide surface, which venturi effect results in a suction action between those mutually parallel surfaces. In actual fact however, because of its roughness, on each of its sides the web of paper entrains with it a layer of air which can be several centimeters thick when measured perpendicularly to the direction of movement, when high speeds are involved. By virtue of the fact that a "funnel" which tapers in a downstream direction and which is formed by the web of paper and the curved surface portion provides that the above-mentioned layer of air is entrained and pressed into the downstream-disposed air gap of uniform width, a sufficiently high pressure occurs in that air gap that it reliably prevents contact between the web of paper and the guide surface. In order to ensure that there is a sufficiently increased pressure when the web of paper is moving at lower speeds, for example when the printing machine is being started up or when it is being slowed down, the apparatus may preferably have a device for injecting blowing air into the air gap between the web of paper and the guide surface. The amount of air which is required for that purpose is considerably less than the amount of air which was circulated by the second impingement jet nozzle arrangement that was previously considered necessary, and the associated fan.

Therefore, by virtue of the/dryer arrangement according to the invention, without a reduction in the drying effect it is possible to omit one of a respective pair of impingement jet nozzle arrangements and the associated fan, so that a 50% reduction in fan output is achieved. In the case of a rotary intaglio printing machine which includes eight printing mechanisms for double-sided 4-ink printing, that results in an immense saving of energy.

In conventional rotary intaglio printing machines, it is necessary to arrange a respective so-called steam lance downstream of each of the drying apparatuses. That is a pipe which extends transversely to the direction of movement of the web of paper and which has a plurality of nozzle openings through which steam or water vapour flows onto the web of paper in order to moisten it. That corrects a shrinkage process that the web of paper suffers in the conventional dryers and which would otherwise have an adverse effect on register accuracy.

A particular advantage of the drying apparatus according to the invention is that the above-mentioned steam lance can be integrated into the apparatus. Preferably it is arranged immediately downstream of the device for injecting air into the air gap formed between the web of paper and the guide surface, so that the steam or water vapour also flows into that air gap. By virtue of that configuration, unlike the state of the art in which the major part of the water vapour or steam does not penetrate into the web of paper, it is possible to achieve very intensive moistening of the web of paper, whereby heat energy is additionally saved.

Furthermore, the heat content of the steam contributes to improved diffusion of the solvent out of the paper and the layer of ink applied thereto. If in addition, as is preferably the case, the housing of the drying apparatus according to the invention is of such a configuration that it is completely closed, with the exception of two narrow gaps through which the web of paper passes into and out of it, the air circulating in the dryer housing is enriched with moisture so that the web of paper shrinks to a lesser degree, from the outset.

A further advantage of the almost closed housing configuration is that the air circulating in the housing can be enriched with solvent to a substantially greater degree, without solvent vapours issuing from the dryer housing. Therefore, the air which is sucked out of the dryer housing can achieve levels of solvent concentration close to the value, which is admitted by law, of 50% of the lower explosion limit, whereby the level of efficiency of the solvent adsorption installation is considerably improved. In addition, there is no need for air to be sucked out of the machine hood.

In rotary intaglio printing machines which have a final drying section in which the remaining solvent content in the finally printed product is further reduced, it is advantageous for the air which is produced in that final drying section and which has a high heat content but which is only relatively slightly charged with solvent vapours to be fed to the drying apparatus according to the invention in order here to make use of a part of the heat produced in the final drying section and further to enrich the air with solvent before the air is fed to the separation installation.

To sum up it is to be emphasised that the features according to the invention can not only considerably reduce the electrical power required for operation of the drying apparatus but they can also substantially reduce the distance that the web of paper must cover in passing through the drying apparatus, in order to permit further processing without the risk of smudging of the ink. In actual fact the drying section becomes so short that the web of paper can pass through the drying apparatus in a straight line between the entry and exit openings, and the drying apparatus does not require any guide spindles whatsoever. Accordingly a drying apparatus of that kind is of optimum suitability for installation in a rotary intaglio printing machine in which the printing mechanisms are arranged one above the other in a tower-like construction and the web of paper is guided in each of the towers only by the plate cylinders and impression cylinders of the printing mechanisms, but is otherwise contact-free.

Further objects, features and advantages of the present invention will be apparent from the following description of a preferred embodiment.

DESCRIPTION OF THE PREFERRED EMBODIMENT

Figure 1:
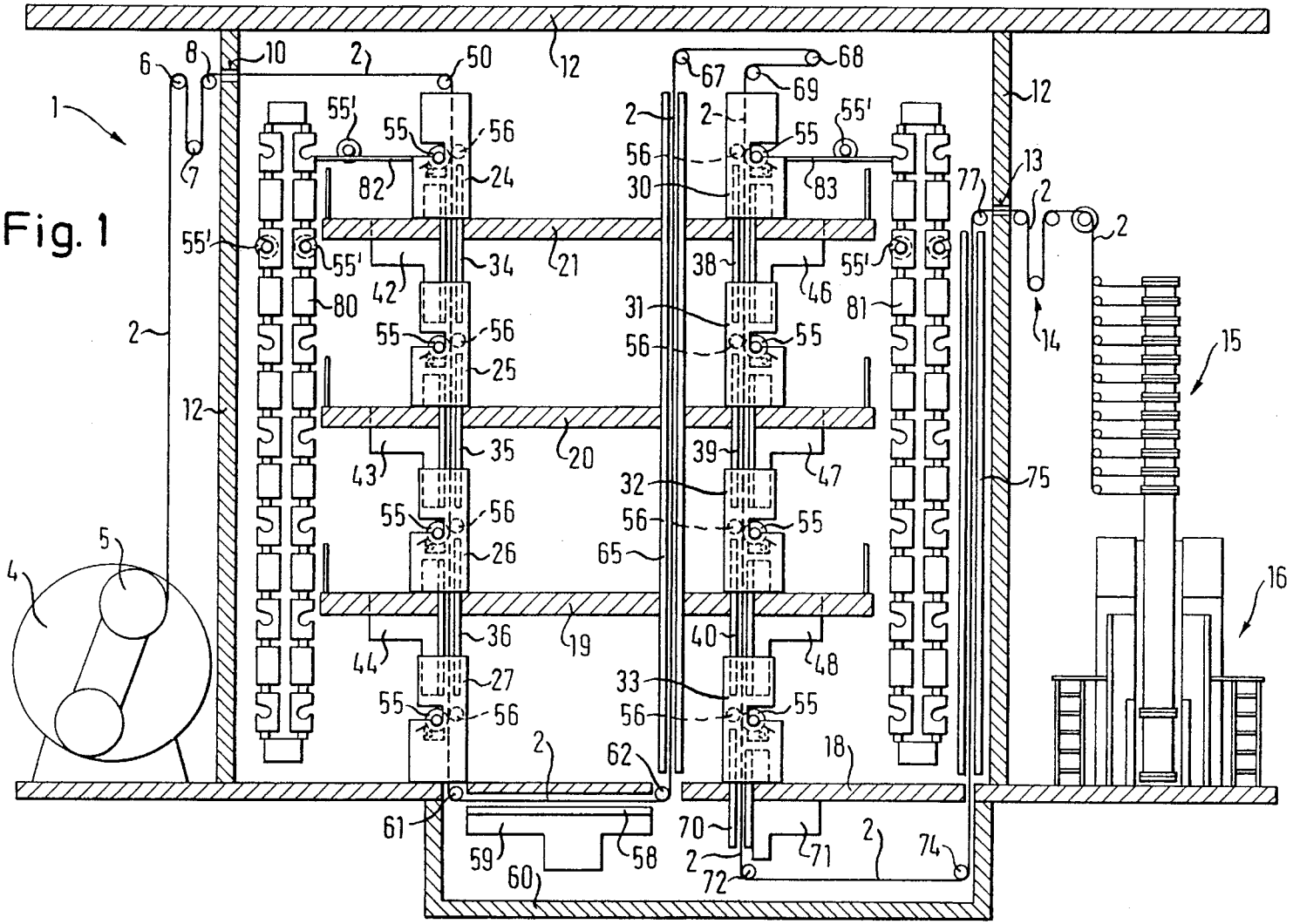
FIG. 1 is a highly diagrammatic side view of a rotary intaglio printing machine according to the invention for four-color printing on both sides of a web of paper.

Referring firstly to FIG. 1, a rotary intaglio printing machine as shown therein and generally identified by reference numeral I serves for printing in four colors on both sides of a web of paper 2 which is drawn from a paper roll 5 mounted on a roll carrier 4. From the paper roll 5, the web of paper 2 extends substantially vertically upwardly to first, second and third guide spindles 6, 7 and 8 which serve to change the direction of movement of the web of paper 2 into a horizontal path in the upper part of the machine. Of the guide spindles 6, 7 and 8, the guide spindle 7 also serves as a tensioning roller so that, as the web of paper 2 passes from the paper roll 5 to the first printing mechanism as indicated at 24, the tension in the paper can be regulated once again to the correct value.

The horizontal portion of the web of paper 2, which follows the guide spindles 6, 7 and 8, passes through a narrow entry slot 10 into a region of the building which encloses the entire rotary intaglio printing machine 1 in the manner of a capsule as indicated at 12. During operation of the machine, the capsule 12 is completely sealingly closed off, with the exception of the above-mentioned entry slot 10 and an exit slot 13 which is disposed on the opposite side from the entry slot 10 and through which the fully printed web of paper 2 leaves the capsule 12 again. The entry and exit slots 10 and 12 can be suitably closed off as required.

Downstream of the exit slot 13, the web of paper 2 with printing on both sides thereof passes through a device 14 which again comprises first, second and third guide spindles, for adjusting the register condition, into a subsequent superstructure 15 which is only indicated in the drawing. In the superstructure 15, the web of paper is longitudinally divided and laid in superposed relationship by means of turning bars and transversely severed by means of bladed rollers until the web of paper is then folded in a folding apparatus 16 to give the respective product, and collected.

Disposed in the interior of the encapsulating enclosure 12 on the floor 18 of the building and three galleries 19, 20 and 21 to which personnel have access on foot, are two groups each consisting of four printing mechanisms 24, 25, 26, 27 and 30, 31, 32, 33 which are arranged in vertically superposed relationship. Of the printing mechanisms, the first group 24 through 27 serves to print on the first form side of the paper with the four colors yellow, red, blue and black, while the second group 30 through 33 serves for printing on the back side of the paper with those colors.

Disposed between successive printing mechanisms of each of those two groups, which are each arranged in a tower-like configuration, are short drying sections in the form of drying devices 34, 35, 36 and 38, 39, 40 respectively. Associated with each of the drying devices 34 through 36 and 38 through 40 are respective draw-off hoods 42, 43, 44 and 46, 47, 48 respectively.

After the web of paper 2 has passed through a horizontal part of its path of movement, downstream of the entry slot 10, the web of paper 2 is deflected downwardly by way of a guide spindle 50 in such a way that it passes vertically from above into the uppermost printing mechanism 24 of the first group or tower formed by the printing mechanisms 24, 25, 26 and 27. The web of paper 2 passes through that entire tower of printing mechanisms, that is to say all the printing mechanisms 24 through 27 thereof and the drying devices 34, 35 and 36 arranged therebetween, downwardly in a vertical direction in such a way that, in doing so, it comes into contact only with the four plate cylinders 55 of the respective printing mechanisms and the associated impression cylinders 56. That therefore means that the printing side of the web of paper comes into contact only with the plate cylinders, while the side which is not to be printed upon in the printing mechanisms comes into contact only with the impression cylinders 56. The short drying devices 34 through 36 are sufficient to dry at least the surface of the ink applied in the respectively preceding printing mechanism 24 through 26, to such a degree that that surface is not wiped or smudged or blurred in the respectively following printing mechanism 25 through 27.

A drying device 58 with associated draw-off hood 59 is also arranged downstream of the lowermost printing mechanism 27 in the first printing mechanism tower arrangement. The drying device 58 and the hood 59 are disposed in a trough 60 beneath the floor 18 of the building, the interior of the trough 60 communicating with the enclosed interior of the capsule 12. For reasons of saving space, the drying device 58 is arranged horizontally so that a guide spindle 61 is disposed between the drying device 58 and the printing mechanism 27 disposed upstream thereof. The guide spindle 61 bears against the back side of the web of paper 2, that is to say, the side of the web of paper to which printing has not yet been applied. A further guide spindle 62 is disposed downstream of the drying device 58 at the same level as the guide spindle 61 and also bears against the web back.

It will be seen therefore that the guide spindle 61 diverts the web of paper from its vertical path of movement through the printing mechanisms 24 through 27, into a horizontal path of movement through the drying device 58. The guide spindle 62 then diverts the web of paper 2 into a vertical path of movement again. In that path of movement, the web of paper 2 passes upwardly through a long drying device 65 which extends to a position beyond the printing mechanisms 24, 30 arranged at the uppermost gallery 21 in the building. The web of paper 2 as it issues from the long drying device 65 is deflected twice by way of three guide spindles 67, 68 and 69, of which the guide spindle 68 is again displaceable for the purposes of adjusting the register condition. The web of paper then passes from above into the second printing mechanism tower for printing on the back of the web of paper 2, with the printing mechanisms 30 through 33 and the respectively interposed short drying devices 38 through 40 through which the web of paper 2 passes in the same manner as was described above, except that now it is the back of the paper to which printing is applied using four inks.

The first guide spindles which come into contact with the front side of the paper after printing has been applied thereto are the guide spindles 67 and 68. As, at that time, the web of paper has passed through the long drying device 65, that contact is totally non-critical because the inks which have been applied to the front side of the paper in the printing mechanisms 24 through 27 have very substantially dried out.

Adjoining the lowermost printing mechanism 33 of the second printing mechanism tower is a short drying device 70 which leads into the trough 60, with a draw-off hood 71. The web of paper 2 still passes through the drying device 70 in a vertical direction because the downstream-disposed guide spindle 72 which serves to deflect the web of paper 2 into a horizontal direction again comes into contact with the back side of the paper to which printing is applied in the second tower arrangement of printing mechanisms. After passing around the guide spindle 72 and travelling along a short horizontal path of movement in the trough 60, the web of paper 2 is again deflected by means of a guide spindle 74 into a vertical path of movement in which it passes vertically upwardly through a further long drying device 75 which extends approximately as far as the level of the uppermost gallery floor 21. At that location is a further guide spindle 77, by means of which the web of paper 2 is again deflected into a horizontal path of movement in order then to leave the capsule 12 through the exit slot 13.

It will be seen from the foregoing description that the whole of the rotary intaglio printing machine 1 which is suitable for four-color printing on both sides of a web of paper 2 requires only nine guide spindles between the entry slot 10 and the exit slot 13, which approximately corresponds to the number of guide spindles used in a single printing mechanism in a previously conventional rotary intaglio printing machine. The total length of paper which is to be found at any time in the machine according to the invention, that is to say within the encapsulating enclosure 12, is approximately four times the height of the overall arrangement plus its length, that is to say the distance between the entry slot 10 and the exit slot 13. If account is taken of the fact that a conventional rotary intaglio printing machine with eight printing mechanisms requires approximately twice the length and the web of paper in each conventional printing mechanism with associated drying device must twice pass through half the height of the installation shown in FIG. 1, it will be seen that the arrangement of the machine in accordance with the invention halves the length of paper disposed in the installation at any time.

Figure 2:
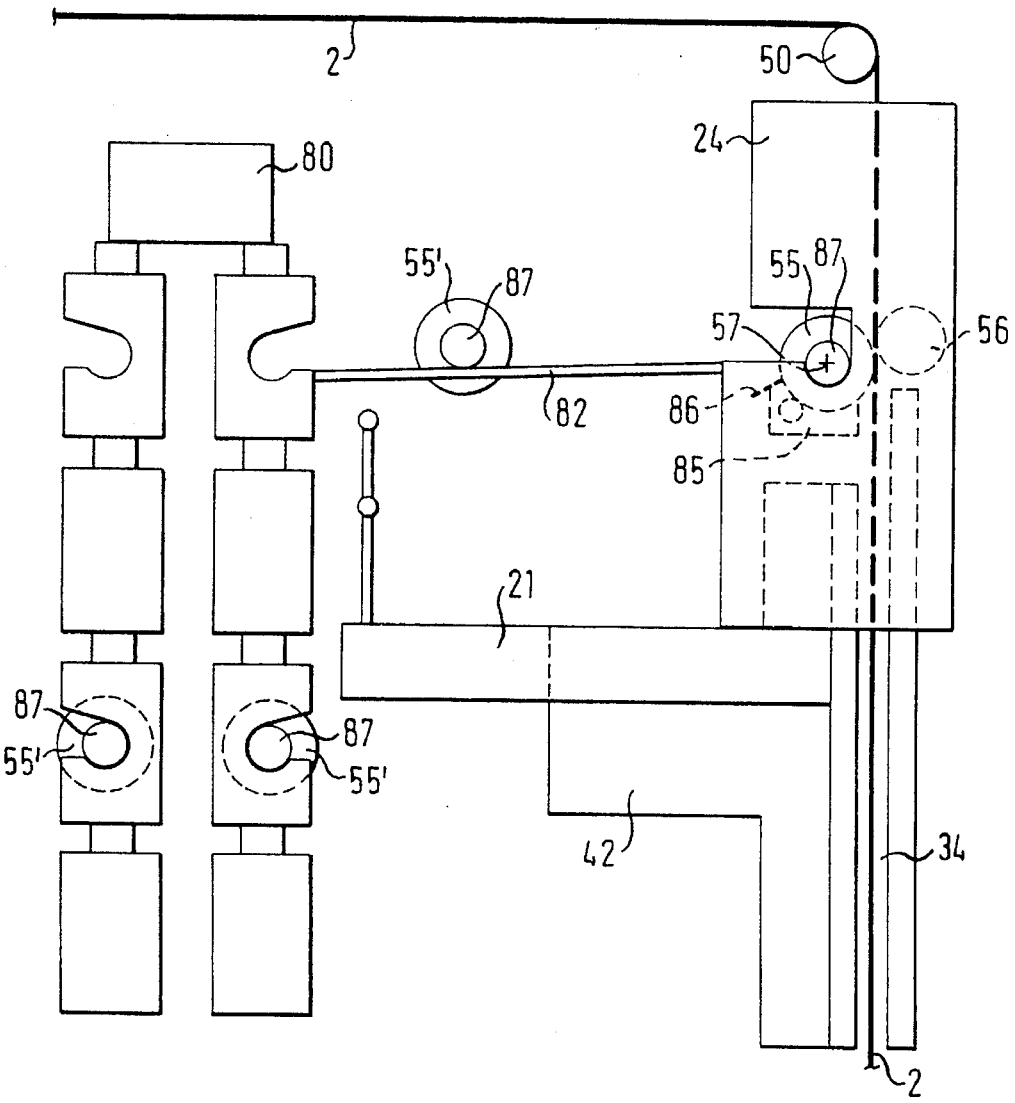
FIG. 2 is a view on a greatly enlarged scale of a detail of the machine in FIG. 1.

Looking now additionally at FIGS. 1 and 2, it will be seen that the printing mechanisms are 'open' towards one longitudinal side so that the plate cylinders can be exchanged by way of that side. In FIG. 1, the 'open' side of the printing mechanisms 24 through 27 of the first tower arrangement is towards the left while the open side of the printing mechanisms 30 through 33 is towards the right. Accordingly, disposed to the left of the tower arrangement formed by the printing mechanisms 24 through 27 and to the right of the tower arrangement formed by the printing mechanisms 30 through 33 are respective elevators 80 and 81 respectively which are here in the form of a paternoster arrangement. By means of the elevators 80 and 81, any plate cylinder 55 which are no longer required can be simultaneously removed from all printing mechanisms of a tower arrangement, and the fresh plate cylinders can be simultaneously supplied to the tower arrangement in a subsequent working operation. That is symbolically indicated in FIG. 1 in respect of the uppermost printing mechanisms 24 and 30 of the two tower arrangements, by means of a respective plate cylinder 55' which is on a conveyor device 82, 83 respectively that leads from the elevator 80 or 81 to the respective printing mechanism 24 or 30. At the level of the upper gallery 21, FIG. 1 shows two plate cylinders 55' in both elevators 80 and 81, in order to show the way in which they are carried in the elements of the paternoster arrangement.

FIG. 2 again shows on a greatly enlarged scale the uppermost printing mechanism 24 of the first tower arrangement for printing on the first or front side of the web of paper 2. FIG. 2 very clearly shows the way in which the plate cylinder 55 dips into an ink trough or fountain 85 and on its exit side is freed of the excess ink by means of a doctor blade 86. The doctor blade is in operation arranged at such a level that the generatrix along which the doctor blade is in contact with the plate cylinder 55 during a printing operation is no higher than the axis of rotation 57 of the plate cylinder and preferably, as illustrated, it is lower than the axis of rotation 57. By virtue of that arrangement, the doctor blade 86 has to be lowered only slightly or not at all when the plate cylinder is to be replaced.

Figure 3:
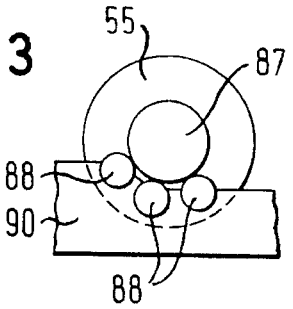
FIG. 3 is a diagrammatic view of the mounting of a plate cylinder shaft journal in a cradle-type mounting and FIG. 4 is a highly diagrammatic, partly sectional side view of a drying apparatus according to the invention.

Referring now to FIG. 3, in order to minimize the height by which the plate cylinder 55 has to be raised when removing same from its printing mechanism and lowered when installing it again, the shaft journals 87 thereof are preferably mounted in the manner shown in FIG. 3 in a backrest-like or cradle-type mounting 90 which has for example three mounting rollers 88.

An important consideration in regard to the entire arrangement of the machine according to the invention is on the one hand that the printing mechanisms for printing on one side of the web of paper are arranged aligned with each other in such a way that the web of paper 2 can pass from one plate cylinder-impression cylinder pair to the next without that involving a substantial change in the direction of movement of the web of paper. In that way, the guidance effect provided by the plate cylinders and the associated impression cylinders is fully sufficient for the web of paper to be guided at least through all the printing mechanisms which are required for printing on one side of the web of paper. That design configuration which thus results in a considerable reduction in the number of guide spindles required can be employed not only with the tower-like arrangement shown in the illustrated embodiment, but also when the printing mechanisms are arranged horizontally one behind the other. It is also possible without departing from the scope of the invention to conceive of rotary intaglio printing machines in which the eight printing mechanisms required for four-color printing on both sides of the web of paper are arranged in four towers, each of which comprises two printing mechanisms in superposed relationship. The invention is also not restricted to four-color printing on both sides, but can be used whenever printing is to be applied to a web of paper by means of two or more printing mechanisms.

On the other hand, another aspect of considerable significance is that the elimination of guide spindles which in previous machines were arranged in the immediate vicinity of the respective printing nips of the printing mechanisms, the lower positioning of the doctor arrangement, and the use of the cradle-type bearings mean that removal and installation of the plate cylinders, transversely to the lengthwise direction thereof, is simplified to such a degree that that operation can be substantially automated.

It will be noted that the elevators 80, 81 can also be arranged outside the encapsulating enclosure 12. In that case, disposed at the level of each printing mechanism outside the capsule 12 is a preparation apparatus which, during a printing operation, is separated from the interior of the capsule 12 by a suitable closure device which for example is in the form of a venetian or slat-type blind device. That affords the advantage that any plate cylinders which are required for the next printing operation in a printing mechanism tower arrangement can be moved into position with a simple lift, while the preceding printing operation is still taking place. When that preceding printing operation is concluded, the closure devices are opened, the plate cylinders which were previously being used are removed from the printing mechanisms and the capsule 12, and put into storage in the preparation apparatus. After that, the plate cylinders required for the next printing operation can be moved into the interior of the capsule 12 and fitted into the respective printing mechanisms. Thereupon the closure devices are closed and the next printing operation can be commenced. After that, there is again sufficient time for the plate cylinders which were previously in use and which have been deposited on the preparation apparatus to be individually lowered by means of the lift to the ground and there transported away.

The final drying device 75 may also be disposed outside the capsule 12.

Figure 4:
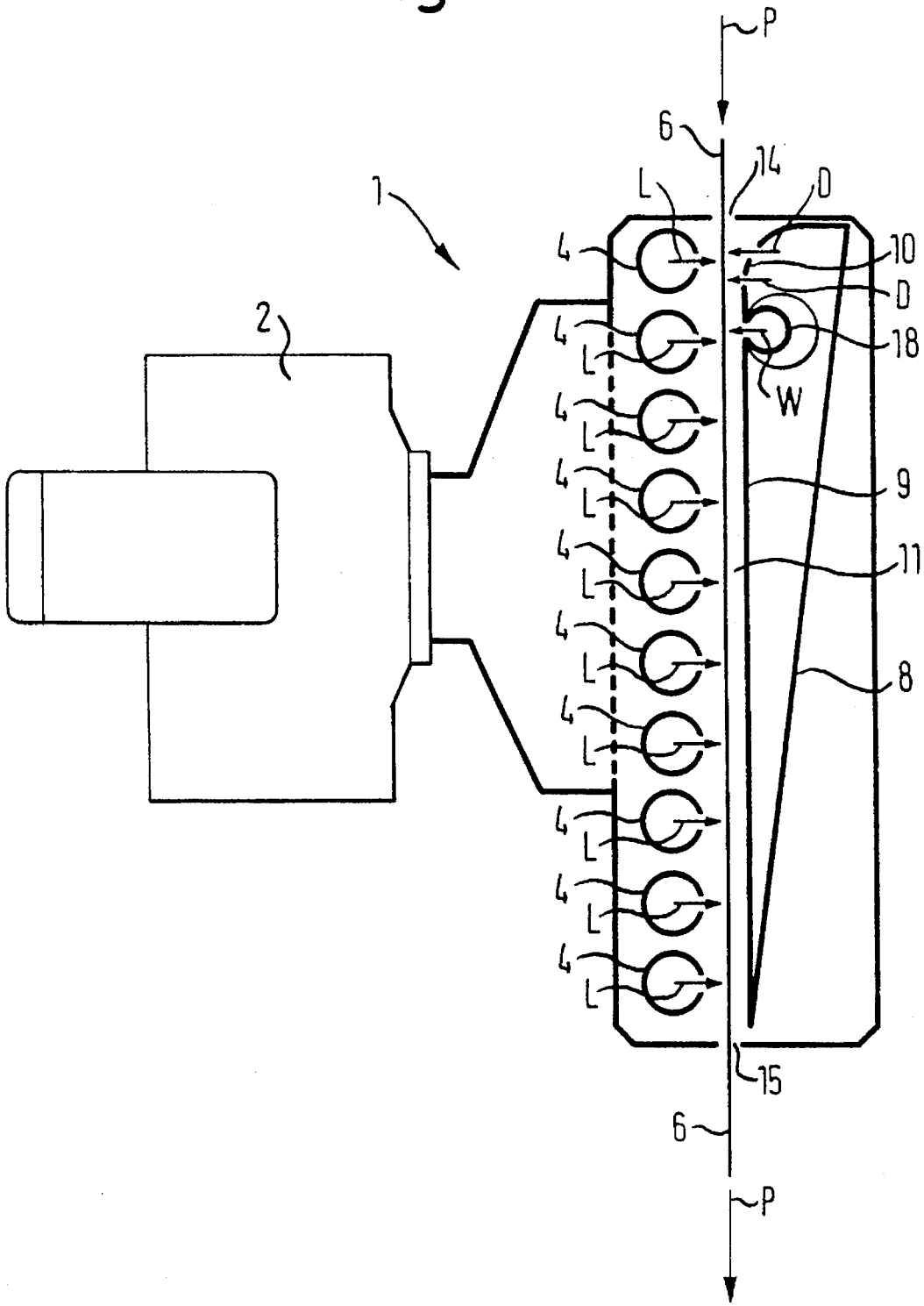

As shown in FIG. 4, a drying apparatus according to the invention includes a substantially closed housing 92. Disposed in the part of the housing which is at the left in FIG. 4 is a fan (not shown) which sucks air out of the interior of the housing and blows it by way of a plurality of nozzle pipes 93 in the direction of the arrows L onto a web of paper 94 which passes through the dryer housing 92 downwardly in the direction indicated by the arrows P. It is assumed in that respect that disposed immediately above the drying apparatus 91 is the printing mechanism of a rotary intaglio printing machine, the web of paper having been printed with ink on the side that is on the left in FIG. 4, in the printing mechanism.

In order to ensure an adequate drying effect, a plurality of mutually parallel nozzle pipes 93 are so arranged that they are disposed in succession in the direction of movement of the web of paper 94 in opposite relationship to the freshly printed side of the web of paper 94. In that configuration the nozzle pipes 93, each of which has a plurality of air discharge nozzles, extend transversely to the direction of movement of the web of paper 94 approximately over the entire width of the web of paper. The connecting conduits by way of which the air coming from the fan is fed to the nozzle pipes 93 cannot be seen in the sectional view in FIG. 4.

Arranged on the side of the web of paper 94 which is opposite to the nozzle pipes 93 is a hollow body 95 which is of an aerofoil configuration in cross-section and is so disposed that a flat surface region 96 of its outside surface extends parallel to the web of paper 94 and at a small spacing therefrom. Perpendicularly to the plane of FIG. 4, the hollow body 95 is also of an extent which approximately corresponds to the width of the web of paper 94 transversely to the direction of movement.

At its upper end the flat surface region 96 goes into a curved surface region 97 whose generatrices, perpendicularly to the plane of the drawing, extend parallel to the web of paper 94 but which in the illustrated sectional view is curved away from the web of paper in such a way that the air gap 98 which is formed between the web of paper 94 and the surface regions 96, 97 increases in width towards the entry end of the web of paper.

In that way, air is entrained into the air gap 98 by the forward movement of the web of paper 94 in the direction of the arrows P, in an amount which is sufficiently large that an air cushion is formed between the web of paper 94 and the guide surface formed by the surface regions 96, 97; at the air cushion, the web of paper 94 can be supported against the pressure exerted by the air flows L of the nozzle pipes 93 without coming into direct contact with the guide surface 96, 97. Paper tears and scratches in the ink which can also already be applied to the side of the paper web 94, that is towards the guide surface 96, 97, are thereby effectively prevented.

As the housing 92 is preferably in the form of an almost closed unit which has only a very narrow entry opening or slot 99 for the web of paper 94 at its upper end and an equally narrow exit opening or slot 100 at its lower end, it may be advantageous, for the purposes of stabilising the air cushion which is built up in the air gap 98 to feed compressed air in the region of the upper end of the air gap, as is indicated by the arrows D. In that respect the interior of the hollow body 95 can be used as a compressed air conduit space. The amount of blowing air that is required per unit of time is substantially less than the amount of air which is blown against the web of paper 94 by the oppositely disposed impingement jet nozzle arrangement formed by the nozzle pipes 93. The energy expenditure required for producing and feeding that blowing air is therefore negligibly low, in comparison with the fan output of the impingement jet nozzle arrangement.

Disposed below the row of compressed air nozzles is a steam lance 101 formed by a pipe which extends transversely to the direction of movement of the web of paper 94 and over the entire width thereof and which has a plurality of nozzle openings which make it possible for water vapour or steam which is supplied through the pipe to be blown onto the web of paper in the direction of the arrow W. That moistening of the web of paper is necessary to prevent the web of paper from shrinking due to extraction of water which otherwise occurs in the dryer, whereby register accuracy would be adversely affected. That arrangement of the steam lance not only permits a reduction in size of the overall printing machine but it also has the advantage that the steam being discharged can be brought into very intensive contact with the web of paper. That reduces the amount of steam required, and that contributes to a saving on energy. In addition the thermal content of the steam is used in the dryer to accelerate diffusion of the solvent out of the ink. It is therefore also possible to save on drying energy.

The conduits which serve to discharge air charged with solvent vapours from the housing 92 and to feed that air to an adsorption and separation installation are not shown in FIG. 4, like optional conduits through which preheated air which possibly already also contains small amounts of solvent can be fed to the housing 92 for example from a final drying section of the printing machine.

Essential aspects which can be clearly seen from FIG. 4 are the short length of the drying section and the fact that the web of paper 94 passes through the dryer housing 92 in a completely contact-free manner, and the drying apparatus therefore manages without guide spindles.

As an alternative to the horizontal arrangement shown in FIG. 1, the drying device 58 arranged beneath the first tower arrangement for printing on the first or front side of the web of paper can also be designed and arranged vertically in the same manner as shown in respect of the drying device 70 at the bottom of the second printing mechanism tower arrangement. In that case, the guide spindle 61 is positioned downstream of the drying device 58 as the web of paper 2 passes in a vertical direction downwardly through the vertically arranged drying device 58, still without being guided thereby, until it then reaches the guide spindle downstream of the drying device 58 for diverting it into a horizontal direction in order for it subsequently to pass upwardly through the long drying device 65.

It will be appreciated that the above-described printing machine and the printing process carried out therein have been set forth solely by way of example and illustration of the principles of the present invention and that various modifications and alterations may be made therein without thereby departing from the spirit and scope of the invention.

What is claimed is:

1. A rotary intaglio printing machine comprising at least a first and a second printing mechanism and a drying means arranged therebetween, said first printing mechanism comprising a first plate cylinder having a longitudinally extending axis of rotation and a first impression cylinder having a longitudinally extending axis of rotation, the axes of rotation of said first plate cylinder and of said first impression cylinder being arranged parallel to each other in such a distance that said two first cylinders define a first printing gap between their surfaces through which first printing gap passes a web of paper for having a first ink printed on a first one of its sides, and said second printing mechanism comprising a second plate cylinder having a longitudinally extending axis of rotation and a second impression cylinder having a longitudinally extending axis of rotation, the axes of rotation of said second plate cylinder and of said second impression cylinder being arranged parallel to each other in such a distance that said two second cylinders define a second printing gap between their surfaces through which second printing gap passes said web of paper for having a second ink printed on said first one of its sides also, and said at least first and second printing mechanisms being aligned with each other such that said first and said second printing gaps lie in a common plane along which said web runs from said first printing mechanism through said drying means to said second printing mechanism with said first side of said web of paper coming into contact with said first and second printing cylinders only, wherein said drying means comprise a housing having an inlet opening and an outlet opening through which openings said web of paper passes, a fan arrangement, and nozzle pipes through which drying air that is sucked from inside of said housing by said fan arrangement is blown inside said housing onto said first side of said web of paper only, said nozzle pipes extending transversely to the direction of movement of said web of paper substantially over the entire width thereof and a guide surface which is arranged in front of said second side of said web of paper in close proximity thereto, whereby an air cushion is formed between said second side of said web of paper and said guide surface, said air cushion supporting said web against the impact of drying air blown onto its first side by said nozzle pipes.

2. A rotary intaglio printing machine as set forth in claim 1, wherein said second one of said sides of said web of paper, on its way between said first and second printing gaps, comes into contact with said first and second impression cylinders and said air cushion only.

3. A rotary intaglio printing machine as set forth in claim 1, wherein for multi-colour printing on said first one of said sides of said web of paper a first tower arrangement comprising at least two printing mechanisms arranged vertically one above the other and for multi-colour printing on said second one of said sides of said web of paper a second tower arrangement comprising at least two further printing mechanisms arranged vertically one above the other are provided.

4. A rotary intaglio printing machine as set forth in claim 3, further including a first guide spindle diverting said web of paper after leaving said first tower arrangement into an at least substantially horizontal direction and a second guide spindle diverting subsequently said web of paper in at least substantially vertical direction.

5. A rotary intaglio printing machine as set forth in claim 4 including a further drying means through which said web of paper passes in said vertical direction downstream of said second guide spindle in a contact-free manner, the length of said further drying means being at least approximately equal to the height of said second tower arrangement.

6. A rotary intaglio printing machine as set forth in claim 1 wherein each plate cylinder has first and second shaft journals and further including a cradle-type mounting for each of the shaft journals of each plate cylinder.

7. A rotary intaglio printing machine as set forth in claim 3 including a building structure in which said tower arrangements are located and which during printing operations is closed capsule-like except an entry slot and an exit slot for said web.

8. A rotary intaglio printing machine as set forth in claim 1, wherein said guide surface includes a flat surface region which extends substantially parallel to said web of paper so that, with the web of paper, the surface region includes an air gap of approximately uniform width, and wherein, at its end which is at the front end in the direction of movement of the web of paper, the flat surface region goes into a curved surface region whose generatrices, transversely to the direction of movement, extend parallel to the web of paper and which in the longitudinal direction is curved away from same in such a way that the air gap enclosed between it and the web of paper increases in width towards the entry side of the web of paper.

9. A rotary intaglio printing machine as set forth in claim 8, wherein the surface regions with which the guide surface is disposed opposite said second one of said sides of the web of paper are somewhat larger than the surface region with which the nozzle pipes are disposed opposite said first one of said sides of said web of paper.

10. A rotary intaglio printing machine as set forth in claim 8, wherein said guide surface is an outside surface of a hollow body arranged beside the path of movement of said web of paper.

11. A rotary intaglio printing machine as set forth in claim 8, wherein a device for injecting supplementary air into said air gap is enclosed between said guide surface and said web of paper.

12. A rotary intaglio printing machine as set forth in claim 11, wherein the device of injecting supplementary air is arranged near said curved surface portion.

13. A rotary intaglio printing machine as set forth in claim 8, wherein a device for injecting steam into said air gap between said guide surface and said web of paper is provided.

14. A rotary intaglio printing machine as set forth in claim 13, wherein in the direction of movement of the web of paper a device for injecting supplementary air is arranged upstream of said device for injecting steam.

15. A rotary intaglio printing machine as set forth in claim 1, wherein said housing is in the form of an almost closed unit with narrow entry and exit openings for the web of paper.

16. A rotary intaglio printing machine as set forth in claim 1, wherein said drying means is fed with heated air which comes from a final drying section of the rotary printing machine and therefore is pre-charged with printing ink solvent.

17. A rotary intaglio printing machine as set forth in claim 16, wherein said heated air from said final drying section is fed to a device for injecting supplementary air into said air gap enclosed between said guide surface and said web of paper.

* * * * *